US009637329B2

(12) United States Patent
Hayayumi

(10) Patent No.: US 9,637,329 B2
(45) Date of Patent: May 2, 2017

(54) SHEET FEEDING APPARATUS AND IMAGE FORMING APPARATUS

(71) Applicant: CANON KABUSHIKI KAISHA, Tokyo (JP)

(72) Inventor: Fumihiko Hayayumi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/707,107

(22) Filed: May 8, 2015

(65) Prior Publication Data

US 2015/0329300 A1 Nov. 19, 2015

(30) Foreign Application Priority Data

May 16, 2014 (JP) ..... 2014-102126

(51) Int. Cl.

| | |
|---|---|
| ***B65H 1/04*** | (2006.01) |
| ***B65H 1/26*** | (2006.01) |
| *B65H 7/14* | (2006.01) |
| *G03G 15/00* | (2006.01) |

(52) U.S. Cl.

CPC ..... *B65H 1/04* (2013.01); *B65H 1/266* (2013.01); *B65H 7/14* (2013.01); *B65H 2405/114* (2013.01); *B65H 2511/10* (2013.01); *B65H 2511/20* (2013.01); *B65H 2553/612* (2013.01); *B65H 2701/1131* (2013.01); *G03G 15/6502* (2013.01); *G03G 2215/00383* (2013.01); *G03G 2215/00734* (2013.01)

(58) Field of Classification Search

CPC ..... B65H 1/04; B65H 2405/1122; B65H 2405/1134; B65H 2405/114; B65H 2405/1142; B65H 2405/1144; B65H 2701/1131; B65H 1/266

USPC ..... 271/171

See application file for complete search history.

(56) References Cited

U.S. PATENT DOCUMENTS

| | | | | |
|---|---|---|---|---|
| 5,931,090 A * | 8/1999 | Ohkawa | B41L 13/06 | 101/118 |
| 6,254,085 B1 * | 7/2001 | Kang | B65H 1/04 | 271/171 |
| 8,360,419 B2 * | 1/2013 | Hiura | B65H 1/266 | 271/171 |

FOREIGN PATENT DOCUMENTS

JP 2010-173806 A 8/2010

* cited by examiner

*Primary Examiner* — Michael McCullough
(74) *Attorney, Agent, or Firm* — Fitzpatrick, Cella, Harper & Scinto

(57) ABSTRACT

A sheet feeding apparatus includes an apparatus body, a storage cassette having a cassette body and a regulation member regulating a position of a sheet, and a size detection portion detecting a size of the sheet. The size detection portion has a plurality of size detection levers which are swung around pivotal shaft, a plurality of non-contact type detection elements which are radially arranged around an imaginary axis on the apparatus body and are turned ON/OFF by the plurality of size detection levers in a case where the storage cassette is mounted, and a positioning unit. The positioning unit positions the storage cassette such that the pivotal shaft and an imaginary axis are matched in a case where the storage cassette is mounted on the apparatus body.

11 Claims, 5 Drawing Sheets

SHEET FEEDING APPARATUS AND IMAGE FORMING APPARATUS

BACKGROUND OF THE INVENTION

Field of the Invention

This disclosure relates to a sheet feeding apparatus and an image forming apparatus, and particularly, to a configuration for detecting sizes of sheets stored in a storage cassette.

Description of the Related Art

In the related art, in an image forming apparatus such as a printer, a sheet feeding apparatus for feeding a sheet to an image forming portion is provided.

The sheet feeding apparatus includes a sheet feeding cassette which is mounted on an apparatus body and in which sheets are stored, and a sheet feeding portion that feeds the sheets stored in the sheet feeding cassette.

The sheet feeding cassette can store sheets having different sizes and if such a sheet feeding cassette is used, a control portion of the image forming apparatus is necessary to determine the size of the sheet in advance to form an appropriate image on the sheet. Thus, in the related art, a sheet feeding apparatus is provided with a size detection sensor for detecting the size of the sheet stored in the sheet feeding cassette. When the sheet feeding cassette is mounted on the apparatus body, the size of the sheet is detected by the size detection sensor.

As the size detection sensor, a sensor has been known which includes a plurality of size detection levers pivoting in accordance with a movement of a regulating plate provided in the sheet feeding cassette to regulate side ends of the sheet and a plurality of detection elements which are disposed on an apparatus body side and which are turned ON/OFF in accordance with pivoting positions of the size detection levers.

Then, when the regulating plate is moved to a position corresponding to the sheet size, and the size detection levers are pivoted to predetermined positions in accordance with the movement of the regulating plate. Thus, if the sheet feeding cassette is mounted on the apparatus body, the size detection levers selectively perform ON/OFF of the detection elements. ON/OFF signals of the detection elements are transmitted to the control portion and the control portion detects the size of the sheet stored in the sheet feeding cassette based on a combination of the ON/OFF signals.

However, in the related art, as described in JP-A-2010-173806, a detection element has been known employing an inexpensive contact type switch. Here, the contact type switch protrudes toward the sheet feeding cassette by a biasing member such as a spring until the contact switch is pressed by the size detection levers. Furthermore, a mounting base holding the contact type switch is also supported to be movable (floating state) and is biased in a protrusion direction of the contact type switch by the biasing member such as the spring.

Thus, in order to operate the switch, the mounting base and the switch have to be pressed by the size detection levers against the biasing force by the biasing member and a large operation force (pressing force) is required when mounting the sheet feeding cassette. In addition, even if the size detection levers are in positions where the size detection levers press the switch, the switch cannot be reliably pressed due to the shape of a contact portion of the size detection levers and the switch or mounting backlash, and the like. In this case, it is not possible to accurately detect the size of the sheet.

Thus, as the detection element, a non-contact type sensor, for example, a photo sensor may be used. In this case, since the lever does not come into contact with the photo sensor, it is possible to reduce the operation force. In addition, since it is a non-contact type, it is possible to prevent erroneous detection of the size of the sheet due to the shape of the contact portion of the size detection levers and the switch, or mounting backlash, and the like as when using the contact type switch.

However, light emitted from a light-emitting portion is received by a light receiving-portion or is shielded by a light shielding portion, and thereby in such a manner the photo sensor is intended to be turned ON/OFF. Thus, for example, in a case where the light shielding portion is provided in the size detection levers, if the sheet feeding cassette and the size detection levers are not accurately positioned when mounting the sheet feeding cassette, it is not possible to accurately detect the sheet size.

SUMMARY OF THE INVENTION

According to an one aspect of this disclosure, a sheet feeding apparatus is provided, including an apparatus body; a storage cassette including a cassette body which is provided in the apparatus body to be mountable and in which sheets are stored, and a regulation member which is supported on the cassette body to be movable and regulates positions of the sheets stored in the cassette body; and a size detection portion detecting sizes of the sheets stored in the cassette body. The size detection portion includes a plurality of size detection levers each of which has one end that comes into contact with the regulation member and is swung around a pivotal shaft in accordance with a movement of the regulation member; a plurality of non-contact type detection elements which are radially provided in the apparatus body around an imaginary axis and are turned ON/OFF by the plurality of size detection levers in a case where the storage cassette is mounted; and a positioning unit positioning the storage cassette such that the pivotal shafts of the plurality of size detection levers and the imaginary axis are matched in a case where the storage cassette is mounted on the apparatus body.

Further features of the present invention will become apparent from the following description of exemplary embodiments with reference to the attached drawings.

DESCRIPTION OF THE EMBODIMENTS

Figure 1:
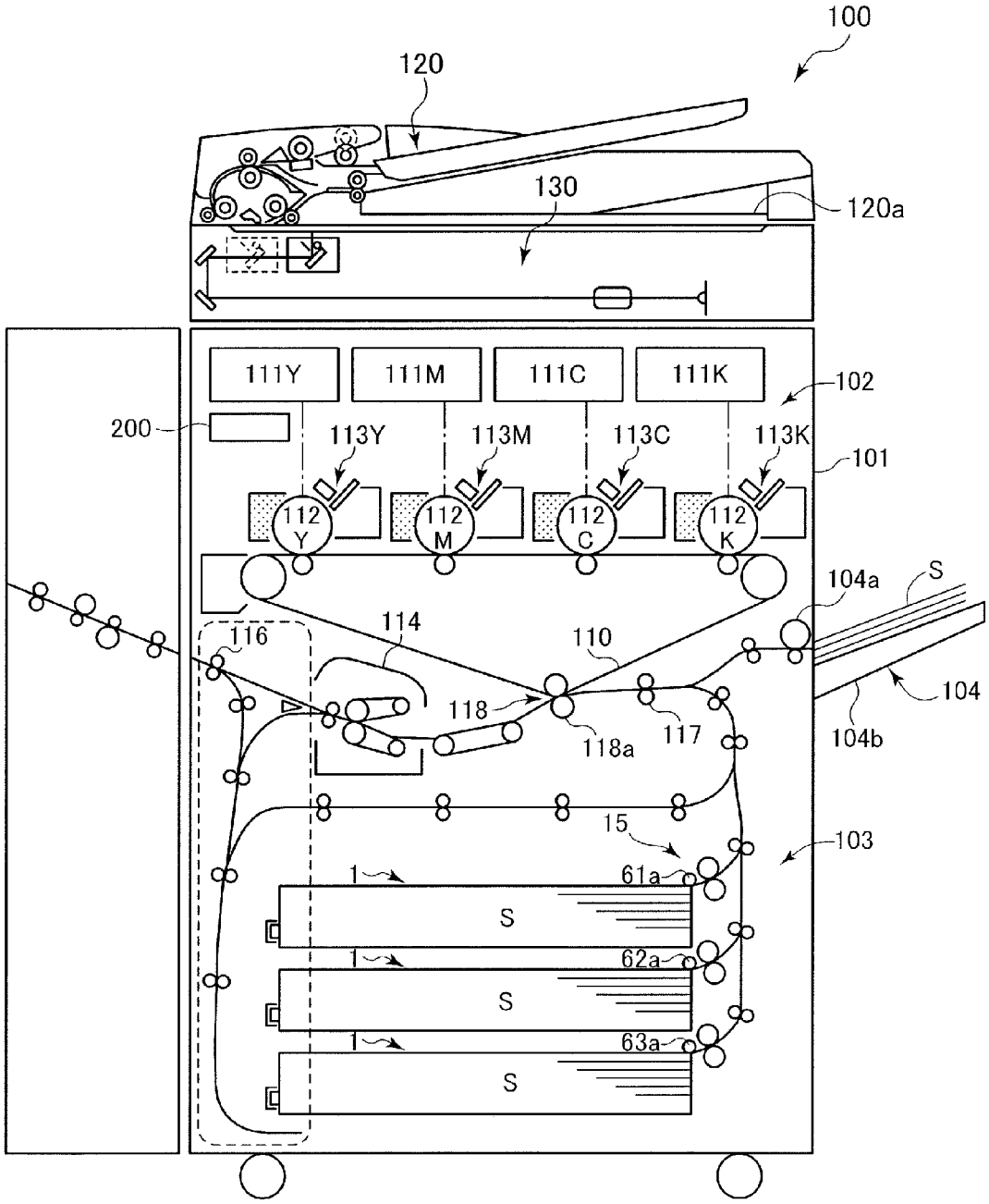
FIG. 1 is a view illustrating a schematic configuration of a printer that is an example of an image forming apparatus including a sheet feeding apparatus according to an embodiment of this disclosure.

Hereinafter, an embodiment of this disclosure will be described with reference to the drawings. FIG. 1 is a view illustrating a schematic configuration of a printer that is an example of an image forming apparatus including a sheet feeding apparatus according to the embodiment of this disclosure.

In FIG. 1, reference numeral 100 is a printer and reference numeral 101 is a printer body. An image reading portion 130, configured to read a document conveyed by an auto document feeder 120 or a document mounted on a platen glass 120*a*, is provided on an upper portion of the printer body 101. An image forming portion 102, a sheet feeding apparatus 103 feeding sheets S to the image forming portion 102, and a manual sheet feeding portion 104 are provided below the image reading portion 130.

The image forming portion 102 is provided with laser scanner units 111Y, 111M, 111C, and 111K, and process cartridges 113Y, 113M, 113C, and 113K. Then, the process cartridges 113Y, 113M, 113C, and 113K are provided with photoconductive drums 112Y, 112M, 112C, and 112K, and the like. Moreover, in FIG. 1, reference numeral 200 is a control portion. Furthermore, four process cartridges 113Y, 113M, 113C, and 113K respectively form four color images of yellow (Y), magenta (M), cyan (C), and black (K). The four process cartridges 113Y, 113M, 113C, and 113K have the same configuration other than that colors of the images to be formed are different from each other. Hereinafter, only an image forming operation of the process cartridge 113Y is described and description of the process cartridges 113M, 113C, and 113K will be omitted.

Next, an image forming operation of the printer 100 having such a configuration will be described. If an image reading signal is output from the control portion 200 provided in the printer body 101 to the image reading portion 130, an image of a document is read by the image reading portion 130. Thereafter, laser light corresponding to an electrical signal is emitted from the laser scanner unit 111Y to the photoconductive drum 112Y.

In this case, the photoconductive drum 112Y is charged in advance, the laser light is emitted by the laser scanner unit 111Y, and thereby an electrostatic latent image is formed. Then, the electrostatic latent image is developed by a developing roller (not illustrated) and thereby a toner image is formed on the photoconductive drum 112Y. Similarly, toner images of magenta (M), cyan (C), and black (K) are also formed on the photoconductive drums of the process cartridges 113M, 113C, and 113K. The toner image of each color formed on each photoconductive drum is sequentially and primarily transferred onto an outer periphery of an intermediate transfer belt 110 and thereby a full-color toner image is formed on the intermediate transfer belt 110.

If a sheet feeding signal is output from the control portion 200 to the sheet feeding apparatus 103, the sheet S stored in a sheet feeding cassette 1 is delivered by a sheet feeding portion 15 provided in the sheet feeding apparatus 103. In addition, if the sheet feeding signal is output from the control portion 200 to the manual sheet feeding portion 104, the sheet S mounted on a sheet tray 104*b* is fed by a sheet feeding roller 104*a*. Thereafter, after a skew of the delivered sheet S is corrected by a registration roller pair 117, the sheet S is transported to a transfer unit 118 that is configured of the intermediate transfer belt 110 and a secondary transfer roller 118*a* by being synchronized with the toner image on the intermediate transfer belt 110.

The toner image on the intermediate transfer belt 110 is transferred on the sheet S delivered to the transfer unit 118 and then the sheet S is conveyed to a fixing portion 114. An unfixed image is fixed on the sheet S by heating and pressing by the fixing portion 114. The sheet S on which the image is fixed is discharged from the printer body 101 by a discharging roller 116.

In the embodiment, the sheet feeding apparatus 103 includes a plurality of sheet feeding cassettes 1, 1, and 1 (storage cassettes) that is provided to be mountable and drawable on/from the printer body 101 also serving as an apparatus body of the sheet feeding apparatus 103. A paper, or OHT (overhead transparency), and the like as the sheet are set by a user in each sheet feeing cassette 1. Supply of the sheet to the sheet feeding cassette 1 is performed in a state where the sheet feeding cassette 1 is drawn out.

Figure 2A:
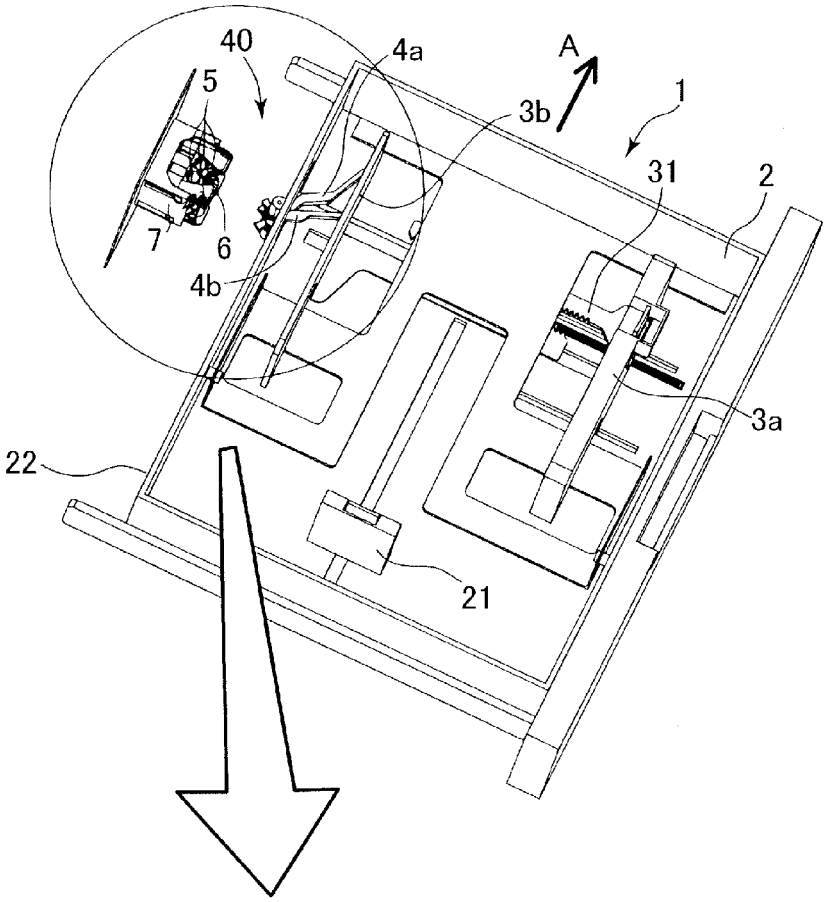
FIG. 2A is a view illustrating a configuration of a sheet feeding cassette and a sheet size detection portion mounted on the printer.

Here, as illustrated in FIG. 2A, the sheet feeding cassette 1 includes a cassette body 2 and a trailing end regulating member 21 that is supported to be slidable parallel to a sheet feeding direction (arrow direction A) within the cassette body and regulates a position of a trailing end that is on an upstream end of the sheet in the sheet feeding direction. Furthermore, the sheet feeding cassette 1 includes a pair of side end regulation members 3*a* and 3*b* that are supported to be slidable (movable) in a width direction orthogonal to the sheet feeding direction within the cassette body 2 and position both side ends of the sheet in the width direction.

The side end regulation members 3*a* and 3*b* respectively have rack portions 31 and the rack portions 31 respectively mesh with a pinion gear (not illustrated) disposed at a center of the cassette body 2 in the width direction. Thus, the side end regulation members 3*a* and 3*b* move symmetrically around the pinion gear and can position side ends in the width direction from the sheet having a minimum sheet width size to the sheet having a maximum sheet width size.

Figure 2B:
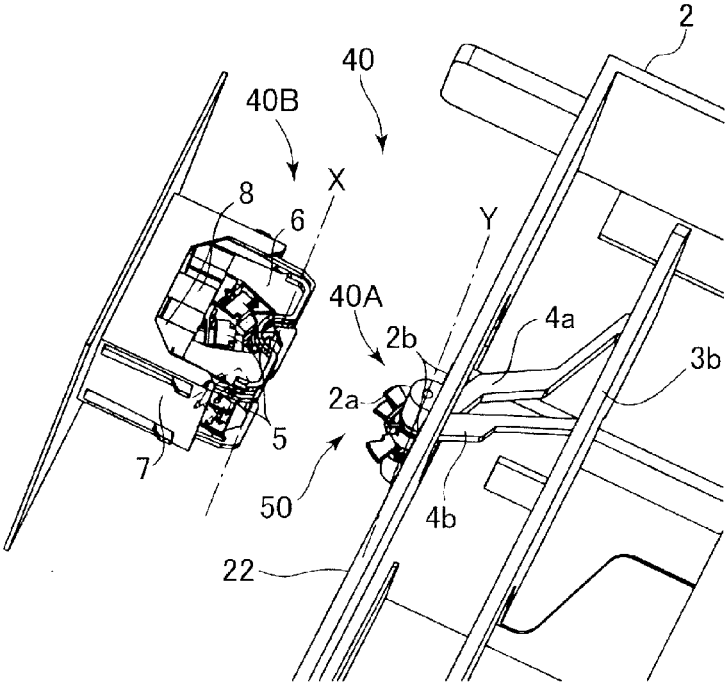
FIG. 2B is an enlarged view illustrating the sheet size detection portion.

Meanwhile, in FIG. 2B, the sheet feeding apparatus 103 includes a sheet size detection portion that detects a size of the sheet stored in the sheet feeding cassette 1. The sheet size detection portion 40 (size detection portion) includes a detected portion 40A having two (plurality) lever members 4*a* and 4*b* provided to be swingable in the sheet feeding cassette 1. Furthermore, the sheet size detection portion 40 includes a detection portion 40B that is provided in the printer body 101 and outputs a signal for detecting the size of the sheet depending on the positions of the lever members 4*a* and 4*b*.

In addition, the sheet size detection portion 40 includes a positioning unit 50 for positioning the positions of the lever members 4*a* and 4*b* with respect to the detection portion 40B such that the size of the sheet can be accurately detected when the sheet feeding cassette 1 is mounted. The positioning unit 50 includes positioning projecting portions 22*a* and 22*a* (shaft support portions), rotation positioning portions 22*b* and 22*b* (regulating portions), and a positioning concaved portion 6*a* (concaved portion) described below.

Figure 3A:
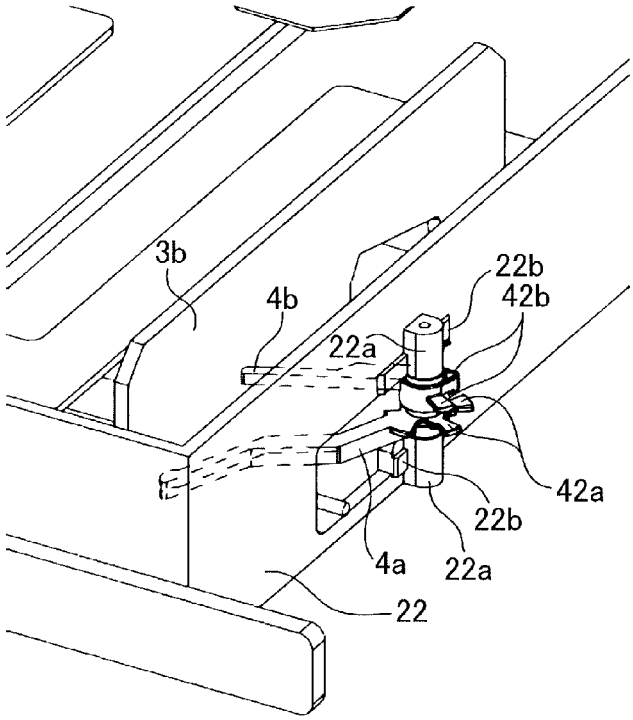
FIG. 3A is a view illustrating lever members of the sheet size detection portion.
Figure 3B:
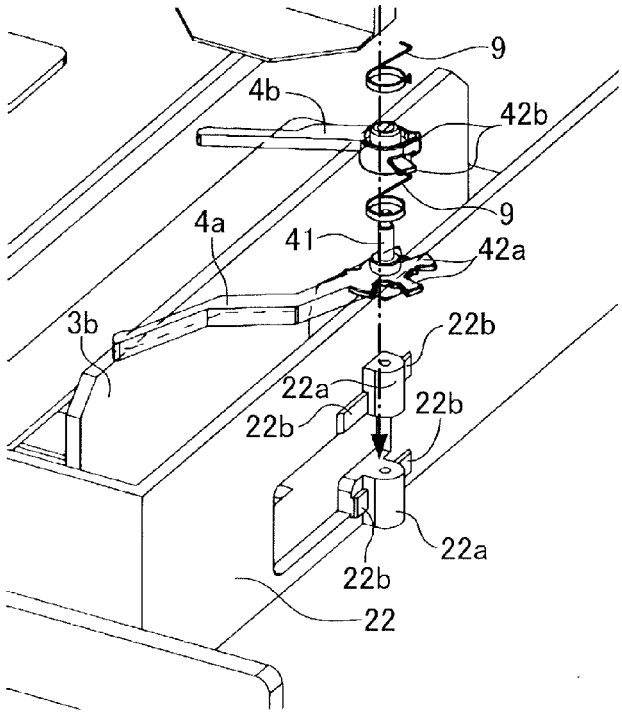
FIG. 3B is an exploded view illustrating the lever members.

As illustrated in FIG. 3A, the lever members 4*a* and 4*b* are supported to be swingable on a side plate 22 (front end side of the cassette body 2) that is on a down stream end in the mounting direction of the cassette body 2. Specifically, the lever members 4*a* and 4*b* are supported to be swingable on the same shaft by the positioning projecting portions 22*a* and 22*a* that are shaft support portions disposed in an outer peripheral surface of the side plate 22 with a predetermined gap in a vertical direction. Moreover, as illustrated in FIG. 3B that is an exploded view of FIG. 3A, the lever member 4*a* of the lever members 4*a* and 4*b* that are the size detection levers, which is positioned on a lower side, has a shaft portion 41 configuring the pivotal shaft. Then, the lever member 4*a* is held to be swingable in the positioning projecting portions 22*a* and 22*a* through the shaft portion 41. In addition, the lever member 4*b* of the lever members 4*a* and 4*b*, which is positioned on an upper side, is mounted to be swingable on the shaft portion 41 of the lever member 4*a*.

Furthermore, two flag portions 42*a* and 42*b* disposed around the shaft portion 41 are respectively formed on ends of the lever members 4*a* and 4*b*. In addition, the lever members 4*a* and 4*b* are biased toward the side end regulation member 3*b* of a far side and the other end comes into pressure contact with the side end regulation member 3*b* of the far side by a spring 9 illustrated in FIG. 3B. Moreover, in the embodiment, a down stream side in the mounting direction of the sheet feeding cassette 1 is defined as the far side and an upstream side is defined as a near side.

Then, as described above, the lever members 4*a* and 4*b* come into pressure contact with the side end regulation member 3*b* of the far side and thereby the lever members 4*a* and 4*b* swing in accordance with a movement of the side end regulation member 3*b* of the far side in the width direction when moving the side end regulation members 3*a* and 3*b* to the regulating positions corresponding to the size of the sheet. Moreover, since the lever members 4*a* and 4*b* have different lengths, swing amounts of the lever members 4*a* and 4*b* in accordance with the movement of the side end regulation member 3*b* of the far side are different.

Furthermore, in the embodiment, the positioning projecting portions 22*a* and 22*a* of the cassette body 2 have semi-cylindrical shapes and the rotation positioning portions 22*b* and 22*b* extending in the width direction of the sheet orthogonal to the mounting direction are integrally formed in the positioning projecting portions 22*a* and 22*a*. Moreover, in the embodiment, since the plurality (two) of lever members 4*a* and 4*b* are disposed in a height direction of the side plate 22, the positioning projecting portions 22*a* and 22*a*, and the rotation positioning portions 22*b* and 22*b* are disposed vertically across the lever members 4*a* and 4*b*.

Figure 4A:
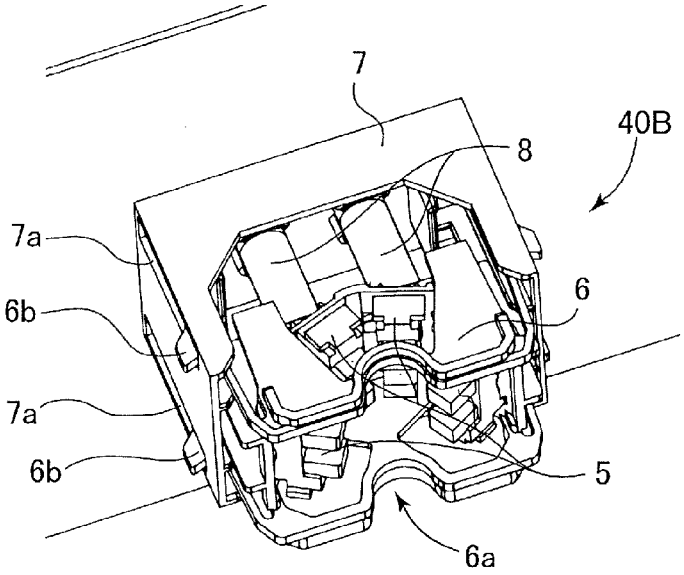
FIG. 4A is a view illustrating a detection portion of the sheet size detection portion.
Figure 4B:
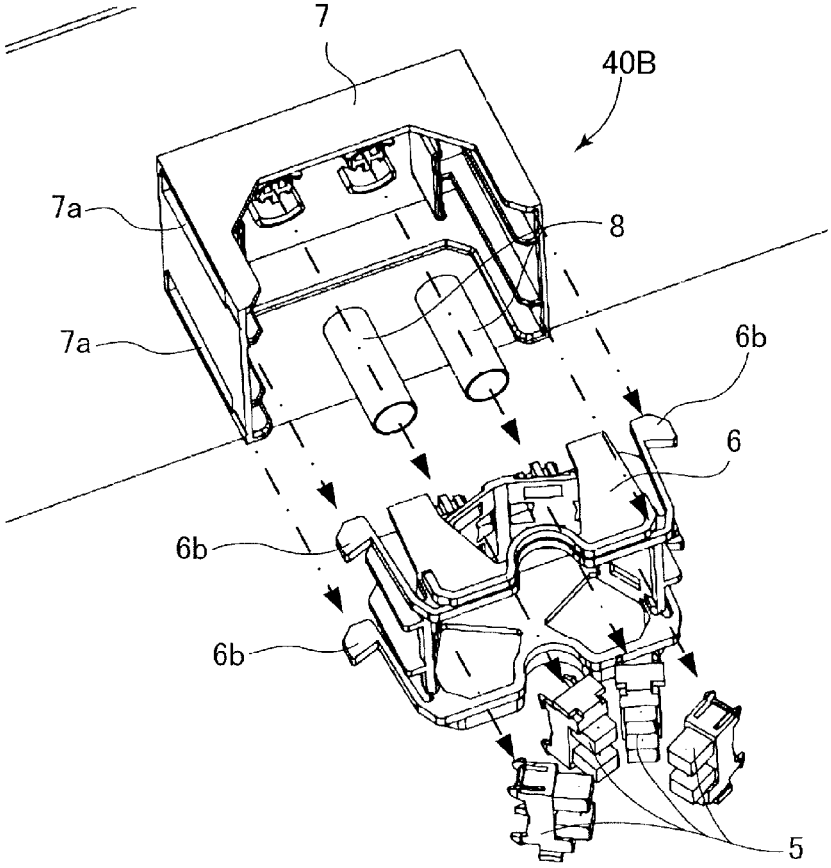
FIG. 4B is an exploded view illustrating the detection portion.

As illustrated in FIG. 4A, the detection portion 40B includes detection elements 5 (a plurality of non-contact type detection elements) that are photo sensors adapted to be turned ON/OFF by shielding or transmitting light by the flag portions 42*a* and 42*b* of the lever members 4*a* and 4*b*, and a mounting base 6 in which the detection element 5 is disposed. The mounting base 6 in which the detection element 5 is disposed is supported on a float base 7 fixed to the printer body 101. The mounting base 6 is supported to be movable in a specific up and down, front and rear, and right and left range on the float base 7, and is biased to protrude toward the cassette by float springs 8 that are biasing members illustrated in FIG. 4B that is an exploded view of FIG. 4A.

Specifically, long holes 7*a* and 7*a* are formed on both side surfaces of the float base 7 and engagement hooks 6*b* provided on both side portions of the mounting base 6 enter the long holes 7*a*. A dimension of the long hole 7*a* in a height direction is set to be greater than a thickness of the engagement hook 6*b* and the engagement hook 6*b* is provided to be elastically deformable inside the float base 7. According to the configuration, the mounting base 6 is supported to be movable (floating state) on the float base 7 within a range in which the long holes 7*a* and the engagement hooks 6*b* are engaged. Then, the mounting base 6 is biased toward the sheet feeding cassette 1 by the float springs 8 and the detection element 5 supported on the mounting base 6 protrudes toward the sheet feeding cassette 1.

Figure 5A:
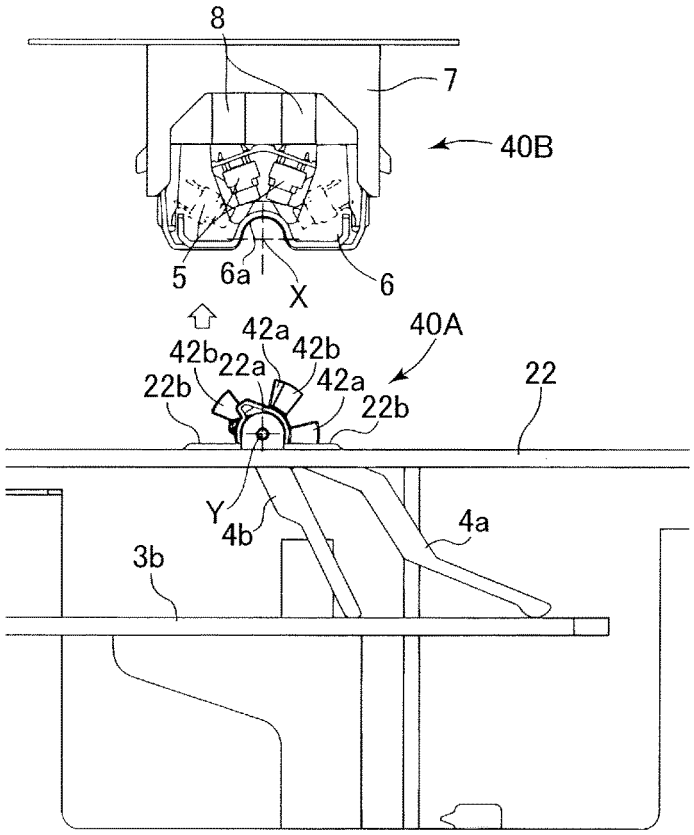
FIG. 5A is a plan view illustrating a state before a detected portion enters the detection portion.

Here, in the embodiment, as illustrated in FIG. 5A described below, four detection elements 5 having the same number as that of the flag portions 42*a* and 42*b* of the lever members 4*a* and 4*b* are radially mounted on the mounting base 6. Furthermore, the four detection elements 5 are respectively disposed in the mounting base 6 at a height at which two flag portions 42*a* of the lever member 4*a* and two flag portions 42*b* of the lever member 4*b* can be detected.

In addition, the positioning concaved portion 6*a* engaging with the positioning projecting portion 22*a* of the sheet feeding cassette 1 is formed on a side wall surface of the mounting base 6 facing the sheet feeding cassette 1. Then, if the sheet feeding cassette 1 is inserted into the printer body 101, the positioning projecting portion 22*a* of the sheet feeding cassette 1 enters the positioning concaved portion 6*a* and a leading end of the mounting base 6 comes into contact with the rotation positioning portion 22*b* provided in the sheet feeding cassette 1. Thus, the mounting base 6 in a floating state is positioned with respect to the sheet feeding cassette 1.

Next, a sheet size detection operation by the sheet size detection portion 40 having such a configuration will be described with reference to FIGS. 5A and 5B. FIG. 5A illustrates a state before the sheet feeding cassette 1 is inserted into the printer body 101 and the flag portions 42*a* and 42*b* of the lever members 4*a* and 4*b* enter the detection portion 40B. In this case, the side end regulation member 3*b* of the far side together with the side end regulation member 3*a* of the near side illustrated in FIG. 2A described above are moved to a position corresponding to the size of the sheet and the lever members 4*a* and 4*b* are swung and moved to positions corresponding to the size of the sheet in accordance with the movement of the side end regulation member 3*b* in the width direction.

Figure 5B:
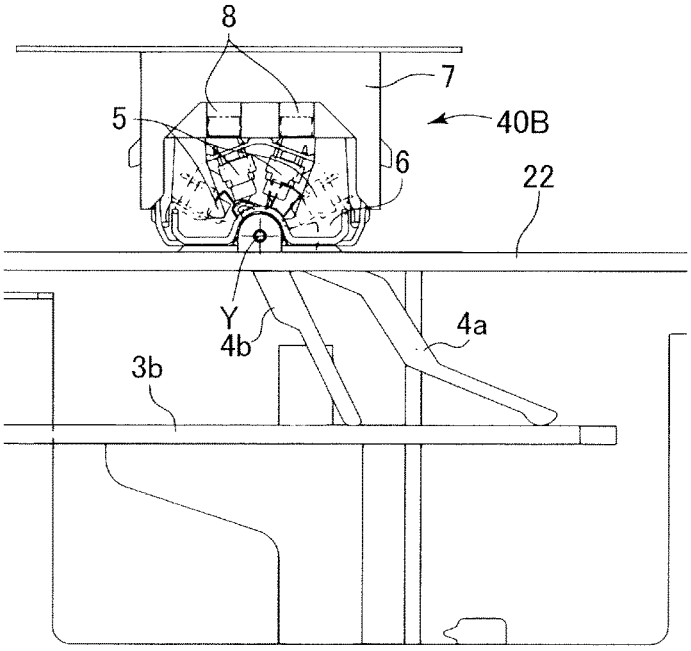
FIG. 5B is a plan view illustrating a state where the detected portion enters the detection portion.

In this state, if the sheet feeding cassette 1 is further pressed, as illustrated in FIG. 5B, the flag portions 42*a* and 42*b* of the lever members 4*a* and 4*b* enter the detection portion 40B, and ON/OFF of the detection elements 5 is performed depending on the positions of the flag portions 42*a* and 42*b* of the lever members 4*a* and 4*b*. Then, ON/OFF signals of the detection elements 5 are output to the control portion 200 and the control portion 200 detects the size of the sheet based on the ON/OFF signals.

Meanwhile, in FIG. 5A, Y indicates a center axis of the shaft portion 41 that is a swing supporting point of the lever member 4*a*. In addition, X indicates an imaginary axis that is a center in a case where the plurality of detection elements 5 is radially disposed. In other words, the detection elements 5 are radially disposed around the imaginary axis X. Then, if the sheet feeding cassette 1 is pressed and the positioning projecting portion 2*a* of the sheet feeding cassette 1 enters the positioning concaved portion 6*a* of the mounting base 6, the center axis Y of the lever members 4 and the imaginary axis X on the mounting base side match each other.

Moreover, in the embodiment, the positioning concaved portion 6*a* has an arcuate inner wall surface centering around the imaginary axis X. When the sheet feeding cassette 1 is mounted on the printer body 101, even if the positioning concaved portion 6*a* and the positioning projecting portion 22*a* are somewhat shifted, since the mounting base 6 on which the positioning concaved portion 6*a* is formed is supported to be movable (floating state) on the printer body 101, the positioning concaved portion 6*a* is engaged with the positioning projecting portion 22*a* while being pressed. Thus, in a state where the sheet feeding cassette 1 is mounted on the printer body 101, it is possible to reliably match the center axis Y of the lever members 4 and the imaginary axis X on the mounting base side, and to accurately detect the size of the sheet stored in the sheet feeding cassette 1.

In addition, in a case where the positioning projecting portion 22*a* enters the positioning concaved portion 6*a*, the rotation positioning portion 22*b* provided in the sheet feeding cassette 1 comes into contact with the leading end of the mounting base 6. Thus, the sheet feeding cassette 1 is positioned with respect to the printer body 101 also in a direction around the center axis Y in addition to the mounting direction. Thus, it is possible to accurately detect the size of the sheet stored in the sheet feeding cassette 1.

That is, if the sheet feeding cassette 1 is pressed, a relative position of the mounting base 6 and the sheet feeding cassette 1 is located by the positioning unit 50 such that the center axis X of the detection element 5 and the swing center axis Y of the levers are matched without the detection element 5 colliding with the lever members 4*a* and 4*b*. Thus, it is possible to reliably detect the size of the sheet without requiring a large operating force.

Furthermore, float springs 8 biasing the mounting base 6 toward the sheet feeding cassette 1 function as dampers when the sheet feeding cassette 1 is inserted into the printer body 101 and reduce an impact when the sheet feeding cassette 1 is mounted on the printer body 101. Thus, for example, it is possible to prevent the flag portions 42*a* and 42*b* of the lever members 4*a* and 4*b* from being damaged by abutting the detection element 5.

In addition, the detection elements 5 are densely and radially disposed, and the positioning projecting portion 22*a*, the rotation positioning portion 22*b*, and the positioning concaved portion 6*a* are disposed to avoid the detection element 5. Thus, it is not necessary to provide a positioning structure by largely increasing a positioning space at both ends of the mounting base 6. Thus, it is possible to save the space.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-102126, filed on May 16, 2014, which is hereby incorporated by reference herein in their entirety.

What is claimed is:

1. A sheet feeding apparatus comprising:

an apparatus body;

a storage cassette including a cassette body which is provided in the apparatus body to be mountable and in which a sheet is stored, and a regulation member which is supported on the cassette body to be movable and regulates positions of the sheet stored in the cassette body; and a size detection portion configured to detect a size of the sheet stored in the cassette body, the size detection portion including:

a size detection member which is swung around a pivotal shaft extended in a direction intersecting with a mounting direction of the storage cassette, in accordance with a movement of the regulation member;

a shaft support portion provided on a downstream side of the cassette body in the mounting direction and configured to swingably support the size detection member around the pivotal shaft;

a plurality of detection elements which are provided in the apparatus body on mutually radially different positions around an imaginary axis and detect the size detection member in a case where the storage cassette is mounted;

a mounting base supported on the apparatus body and integrally supporting the plurality of detection elements;

an engaging portion provided on the shaft support portion; and an engaged portion provided on the mounting base and configured to engage with the engaging portion such that the pivotal shaft of the size detection member and the imaginary axis are collinear in a case where the storage cassette is mounted on the apparatus body.

2. The sheet feeding apparatus according to claim 1, wherein the engaging portion is a projecting portion having a projecting shaft, and the engaged portion is a concave portion having a concave shape.

3. The sheet feeding apparatus according to claim 2, wherein the concave portion includes an arcuate inner wall surface centering around the imaginary axis.

4. The sheet feeding apparatus according to claim 2, further comprising a biasing member biasing the mounting base to the storage cassette and pressing the concave portion to the projecting portion in a process in which the storage cassette is mounted on the apparatus body.

5. The sheet feeding apparatus according to claim 2, wherein the shaft support portion includes a regulating portion extending in a width direction of the sheet orthogonal to the mounting direction and regulating a rotation of the mounting base around the imaginary axis by coming into contact with the mounting base in a case where the sheet feeding cassette is mounted.

6. The sheet feeding apparatus according to claim 1, wherein the size detection member is a first size detection member, the sheet feeding apparatus further comprises a second size detection member which is swung around the pivotal shaft in accordance with a movement of the regulation member, and the first size detection member and the second size detection member are swingable independently.

7. The sheet feeding apparatus according to claim 6, wherein the size detection members include flag portions disposed around the pivotal shaft and performing ON/OFF of the plurality of photo sensors.

8. The sheet feeding apparatus according to claim 1, wherein the size detection member has one end which comes into contact with the regulation member.

9. The sheet feeding apparatus according to claim 1, wherein the detection elements are non-contact type detection elements.

10. The sheet feeding apparatus according to claim 1, wherein the detection elements are photo sensors.

11. An image forming apparatus comprising:

an image forming portion forming an image on a sheet; and the sheet feeding apparatus according to claim 1 feeding the sheet to the image forming portion.

* * * * *